United States Patent [19]

Basch et al.

[11] 4,282,801

[45] Aug. 11, 1981

[54] CRASHWORTHY FUEL PUMP

[75] Inventors: Walter E. Basch, St. Louis; John W. Haney, Florissant, both of Mo.

[73] Assignee: ACF Industries, Inc., New York, N.Y.

[21] Appl. No.: 80,267

[22] Filed: Oct. 1, 1979

[51] Int. Cl.[3] ..... F01B 19/02; F04B 43/12

[52] U.S. Cl. ..... 92/102; 417/471

[58] Field of Search ..... 417/470, 471; 92/98–102

[56] References Cited

U.S. PATENT DOCUMENTS

| | | | |
|---|---|---|---|
| 1,108,146 | 8/1914 | Deegan | 92/102 |
| 2,786,423 | 3/1957 | Coffey | 92/102 |
| 3,362,341 | 1/1968 | Quatredeniers | 417/571 |
| 3,364,870 | 1/1968 | Quatredeniers | 417/571 |

FOREIGN PATENT DOCUMENTS

| | | | |
|---|---|---|---|
| 1413536 | 12/1975 | United Kingdom | 417/471 |

*Primary Examiner*—William L. Freeh

*Attorney, Agent, or Firm*—J. Joseph Muller

[57] ABSTRACT

A fuel pump improvement comprises a leak proof seal formed between the fuel pump body and pumping element. The fuel pump body and a housing are clamped together to form a unified fuel pump assembly.

1 Claim, 4 Drawing Figures

CRASHWORTHY FUEL PUMP

BACKGROUND OF THE INVENTION

This invention relates to fuel pumps and, more particularly, to a crashworthy fuel pump capable of withstanding extreme forces such as occur during a crash without leaking fuel.

Because of their location in the engine compartment of an automobile, fuel pumps are susceptible to damage during a crash as the result of being struck by debris flying about in the compartment. As a consequence, fuel leaks from the pump may occur. The presence of gasoline in the engine compartment due to a broken fuel pump creates a great risk of fire and potential harm to both the vehicle and its occupants.

Federal Motor Vehicle Safety Standard (FMVSS) 30 was issued in an attempt to reduce the hazards attendant the location of the fuel pump in the engine compartment by requiring that the risk of damage to a fuel pump during a crash be minimized. To comply with this standard, various schemes have been proposed to shield the fuel pump or otherwise protect it from flying debris. However, these protective shields add weight to the vehicle, may be difficult to fit into already crowded engine compartments, and may not always prevent an object from striking a fuel pump.

SUMMARY OF THE INVENTION

Among the several objects of the present invention may be noted the provision of a fuel pump improvement by which the fuel pump is made crashworthy; the provision of such an improvement by which a leak proof seal is formed between the pump body and the pumping element of the pump; the provision of such an improvement in which ease of assembly of the fuel pump is also facilitated; and the provision of such an improvement by which the pump has essentially the same envelope as a conventional non-crashworthy fuel pump so as to be readily installed in the engine compartment of a vehicle and take up substantially the same volume.

Briefly, the improvement of the present invention comprises means for sealingly enclosing the outer margin of a fuel pump diaphragm to form a fluid seal between the pumping chamber of the fuel pump and the fuel pump body. Further, means are formed on either the fuel pump body or a housing for the means for flexing the diaphragm to clamp the body and the housing together to form a unified fuel pump assembly. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
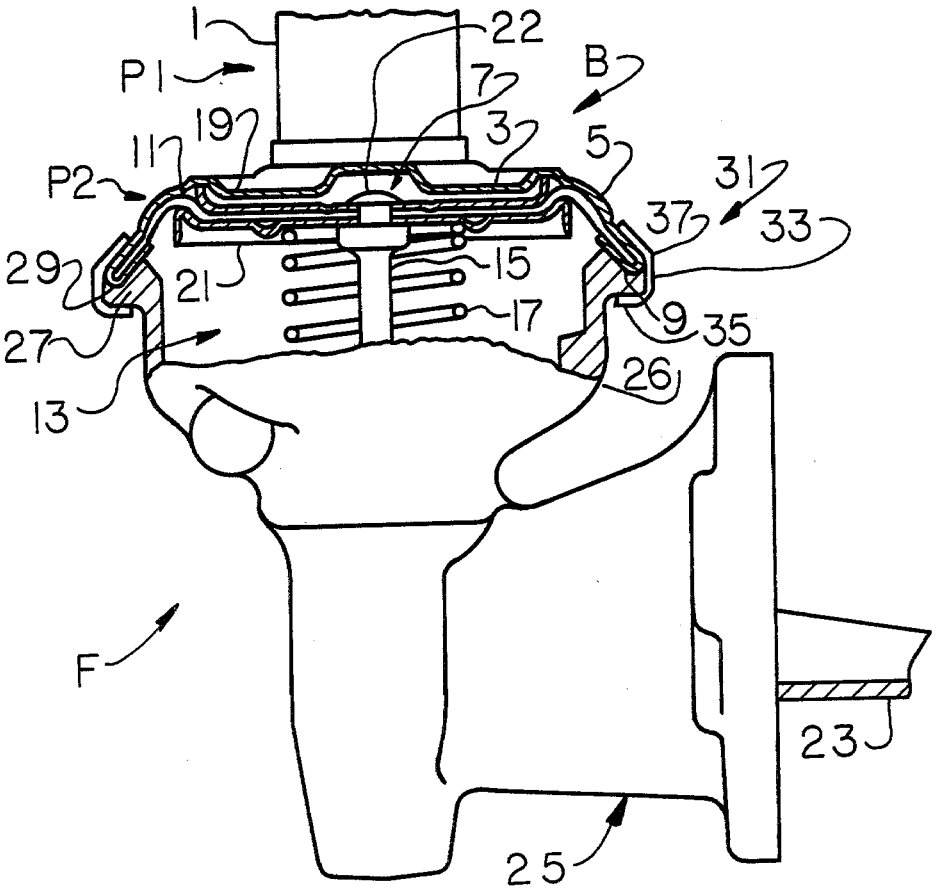
FIG. 1 is a sectional view of a fuel pump installable in the engine compartment of a vehicle.

Referring to the drawings, a fuel pump F for use in an automotive fuel system comprises a pump body, generally indicated B, which is of one-piece, thin-walled, sheet metal construction. Body B has a first portion P1 in which are formed two integral deep-drawn cylindrical cup-shaped projections, one of which is partially shown in FIG. 1 and is indicated by reference numeral 1. One of the projections defines an intake cavity for the fuel pump and the other projection defines a discharge cavity for the pump. A properly oriented check valve (not shown) is located in each cavity to control fuel flow into and out of the fuel pump and appropriate fittings (also not shown) are located at the outer end of each projection for connecting the fuel pump into the fuel system. Check valves and fittings of the type shown in U.S. Pat. No. 3,096,722 to Fitzgerald et al, issued July 9, 1963, are illustrative of those which may be used in fuel pump F.

Body B has a second portion P2 of a shallow cup-shape, having an end wall 3 and a flaring annular peripheral wall 5 forming a fuel pumping chamber 7. One end of each cavity 1 is in fluid communication with the pumping chamber. The lower end of body P2 is open, and a lip 9 is formed around the periphery of this open end.

An annular diaphragm 11 closes pumping chamber 7. The diaphragm consists of a relatively thin disk of flexible, fuel-resistant material, such as a suitable synthetic rubber. In its unstressed condition the diaphragm is essentially flat. The diaphragm is insertable into the open end of the second portion of body B. As shown in FIG. 1, the lip 9 of the pump body bends over the outer margin of the diaphragm to clamp the diaphragm within the pump body. The entire outer margin of the diaphragm is so clamped and the result is a fluid-tight seal between the pump body and the diaphragm.

Means, indicated generally 13, flex diaphragm 11 to pump fuel into and out of pumping chamber 7 through the respective intake and discharge cavities. Means 13 comprises a diaphragm actuating rod 15 and a spring 17. Diaphragm 11 is sandwiched between a pair of backing plates 19 and 21 respectively. Rod 15 extends through the backing plates and the diaphragm and the end of the rod is spun over. One end of spring 17 seats against the underside of plate 21. A rocker arm 23 is operable by an engine driven eccentric cam (not shown). The inner end of the rocker arm is attached to the other end of rod 15 and pulls the rod downward as it is rocked by the cam. This pulls diaphragm 11 downwardly and creates the intake stroke of the pump. Spring 17 pushes the diaphragm upwardly at the end of the intake stroke to produce the discharge stroke of the pump.

Means 13 is housed in a housing 25. The housing has a hollow conical pump head 26. The pump head has an outwardly extending circumferential rim 27, the upper face of which is downwardly and outwardly sloped. At the base of the slope is a shallow groove 29. The groove and slope form a seat for the diaphragm pump body assembly and, in particular, the slope and groove are shaped to accomodate the diaphragm assembly.

A means indicated generally 31 clamps body B and housing 25 together to form a unified fuel pump assembly. As shown in FIG. 1, clamping means 31 comprises a circular ring 33 which is fitted around the body and the housing to join the two together. Ring 33 has an inturned lower margin forming a lip 35. The inner face of this lip abuts the bottom outer surface of lip 27 when the pump is assembled. The ring has an upwardly extending circumferential side 37 whose height is such that the side extends beyond the joining surfaces of body B and housing 35. The upper portion of side 37 is spun over the top of body B after the body and housing are brought into mating abutment so as to clamp the body and housing together as shown in FIG. 1. Ring 33 has sufficient strength so as to keep the fuel pump assembly together when it is subjected to the normal forces encountered during ordinary operations of the vehicle in which the fuel pump is installed.

Figure 2:
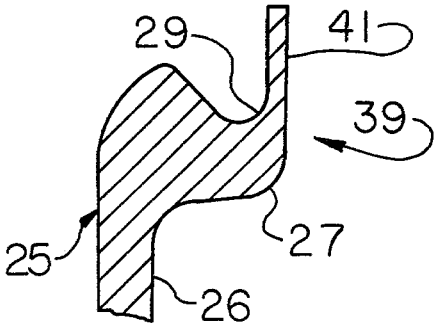
FIGS. 2 and 3 are sectional views of a portion of a fuel pump illustrating a first embodiment of the improvement of the present invention.
Figure 3:
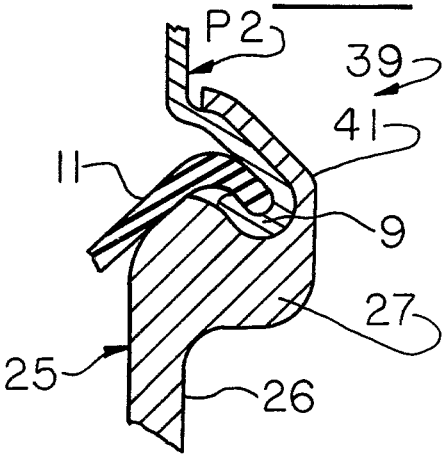

An improvement to the crashworthy fuel pump above described comprises means indicated generally 39 formed on housing 25 for clamping the body and the housing together to form a unified assembly. As shown in FIGS. 2 and 3, means 39 comprises a lip 41 formed around the periphery of the end of housing 25 formed for abutment with the body B. Lip 41 extends upward from rim 27 of the housing thus to permit the body/diaphragm assembly to be positioned atop the housing in the manner previously discussed and shown in FIG. 3. After installation, lip 41 is crimped over body portion P2 to form a completed fuel pump assembly. Such an assembly now has the leak integrity which is important for crashworthiness, as well as simplified assembly, because band 33 has been eliminated. Further, the fuel pump has the same envelope as a conventional, non-crashworthy fuel pump and takes up approximately the same volume in the engine compartment.

Figure 4:
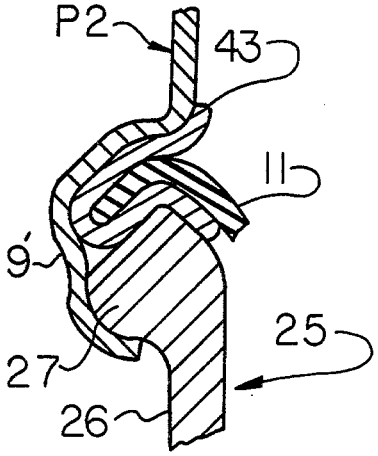
FIG. 4 is a sectional view of a portion of a fuel pump illustrating a second embodiment of the improvement of the present invention.

As shown in FIG. 4, clamping means 39' comprises s bendable band 43 over which one surface of the outer margin of diaphragm 11 is positioned. Band 43 is, for example, a circular metallic band whose lower portion is formed to fit the contour of the upper inner face of housing 25. The outer margin of diaphragm 11 is positioned on the formed portion of the band and the upper portion of the band is then pressed or bent over the top surface of the diaphragm to complete the assembly.

Clamping means 39' further comprises a lip 9' formed around the periphery of the open end of body portion P2. Lip 9', unlike the lip 9 previously described, is long enough so when the body and housing portions of the fuel pump are assembled, the lip, when crimped as shown in FIG. 4, bears against the underside of rim 27 to hold the body and housing portions of the fuel pump together. The band 43/diaphragm 11 assembly is thus clamped between the body and the housing with the band conforming to the shape of the body and the housing at its respective upper and lower ends. Again, the leak integrity necessary for crashworthiness of the fuel pump is achieved as is ease of assembly.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a fuel pump for use in an automotive fuel system, the fuel pump including a body having a first portion in which is formed a fuel intake cavity and a fuel discharge cavity and a second portion in which is formed a fuel pumping chamber, a flexible diaphragm enclosing the pumping chamber, the diaphragm being insertable into the open end of the second portion of the body with the periphery of the fuel pump body at the open end thereof having a lip formed therearound which is bent over the outer margin of the diaphragm to clamp the diaphragm within the pump body and form a fluid tight seal therewith; and means for flexing the diaphragm to pump fuel into and out of the pumping chamber through the respective intake and discharge cavities, the improvement comprising:

a housing for the flexing means, the housing having a hollow pump head with an outwardly extending circumferential rim, the upper face of the rim being downwardly and outwardly sloping with an upwardly extending circumferential lip at the outer margin of the rim, the sloping upper face of the rim and the lip forming a circumferential groove, the housing abutting with the pump body so the fluid seal forming portion of the pump body is received in the groove with the circumferential housing lip being bent over the outer surface of the pump body to complete a unified fuel pump assembly, capable of withstanding abnormal forces such as occur during an automobile crash without a fuel leak resulting.

* * * * *